United States Patent [19]

Clement

[11] Patent Number: 4,987,648

[45] Date of Patent: Jan. 29, 1991

[54] COMBING MACHINE WITH WORKSTATIONS HAVING A MONITORING UNIT AT EACH WORKSTATION

[75] Inventor: Heinz Clement, Winterthur, Switzerland

[73] Assignee: Rieter Machine Works, Ltd., Winterthur, Switzerland

[21] Appl. No.: 340,238

[22] Filed: Apr. 19, 1989

[30] Foreign Application Priority Data

Apr. 19, 1988 [CH] Switzerland ..... 01432/88

[51] Int. Cl.[5] ..... D01G 19/10; D01G 19/24

[52] U.S. Cl. ..... 19/115 R; 19/115 A; 19/0.2; 19/0.21; 19/0.23; 19/0.22

[58] Field of Search ..... 19/0.20, 0.21, 0.22, 19/0.23, 0.25, 0.26, 115 R, 115 A, 126, 127

[56] References Cited

U.S. PATENT DOCUMENTS

| | | | |
|---|---|---|---|
| 1,990,730 | 2/1935 | Fossel | 19/167 |
| 2,670,503 | 3/1954 | Anderson | 19/0.23 |
| 2,716,781 | 9/1955 | Elliott | 19/0.23 |
| 2,811,753 | 11/1957 | Whitehurst | 19/0.23 |
| 3,010,273 | 11/1961 | Bailey | 19/0.25 |
| 3,602,727 | 8/1971 | Schwalm | 19/0.21 X |
| 4,428,097 | 1/1984 | Adamson | 19/0.25 |
| 4,766,647 | 8/1988 | Ackermann | 19/0.22 |

FOREIGN PATENT DOCUMENTS

| | | |
|---|---|---|
| 0026111 | 9/1985 | European Pat. Off. . |
| 0192835 | 3/1986 | European Pat. Off. . |
| 0572529 | 2/1976 | Switzerland . |

*Primary Examiner*—Werner H. Schroeder
*Assistant Examiner*—Ismael Izaguirre
*Attorney, Agent, or Firm*—Kenyon & Kenyon

[57] ABSTRACT

The combing machine is provided with a plurality of workstations each of which is provided with a table containing a funnel through which a combed web is formed into a sliver. Each table is pivotally mounted on a fixed shaft and a monitoring unit is provided to detect the rotation of the table about the shaft in response to a thick or thin place in the combed web passing through the funnel.

20 Claims, 5 Drawing Sheets

COMBING MACHINE WITH WORKSTATIONS HAVING A MONITORING UNIT AT EACH WORKSTATION

This invention relates to a combing machine. More particularly, this invention relates to a control for a combing machine.

As is known, combing machines have been provided for the combing of tufts which are extracted from laps in order to improve the quality of the yarn which is eventually produced from the lap. In many cases, the combing machines have been provided with a plurality of workstations within each of which a combed web is combined into a sliver and delivered over a delivery table for passage to a drawframe.

It has also been known to monitor the workstations of a combing machine such as a Model E7/5 sold by Rieter Machine Works, Ltd. of Winterthur, Switzerland, and to stop machine in the event of an undesirable condition being detected at one of the workstations (hereinafter referred to as an "individual head"). Such an undesirable condition may, for example, be a thick or thin place in the sliver delivered by the individual head. In this case, each workstation includes a table which is pivotally mounted so as to react to a thick or thin place in a sliver passing over the table as well as a monitoring device which utilizes a photoelectric barrier to monitor the pivoting movement of the tables of all of the work stations.

While monitoring units of the above type are adequate to monitor the quality of the end product of a combing machine, such monitoring units do not give information regarding the operating states of an individual head. As such, these monitoring units are not suitable for complete monitoring in a modern automated spinning mill. In addition, a photoelectric barrier extending over the entire machine width of the individual workstations is liable to any disturbance occurring within the scanning zone. Such disturbances, for example, may be an interruption of the beam of light by a brief intervention of some other elements.

Other types of monitoring devices have also been known for employment in textile machines, such as described in European Patents No. 0156153 and 0026111. However, these do not have applicability to the workstations of a combing machine. U.S. Pat. No. 1,990,730 describes a stop motion for a comber while Swiss Patent No. 572,529 describes optical controls for a combing machine. However, such devices have been of general background only and are not pertinent to the workstations of a combing machine.

Accordingly, it is an object of the invention to improve the availability of information concerning the operating states of the individual heads of a combing machine.

It is another object of the invention to improve the quality of a sliver produced from combed webs of fiber.

It is another object of the invention to improve the monitoring of a combing machine.

It is another object of the invention to provide for guaranteed monitoring of the workstations of a combing machine.

Briefly, the invention provides a combing machine which is comprised of a plurality of workstations each of which has means for combing a combed web into a sliver. In addition, each means is movable from a working position in response to a thickened portion or a thinned portion of a combed web passing therethrough. In accordance with the invention, a plurality of monitoring units are provided for the combing machine with each monitoring unit disposed at a respective means for monitoring movement of this means from the working position thereof.

The means for combining a combed web into a sliver may be formed by a pivotally mounted table with a funnel in the table for the passage of a combed web therethrough for combining into a sliver. In addition, spring means are provided for holding the table in the working position.

The table and associated funnel may be disposed so as to be movable between the working position and one or more other positions so that the table is able to move from the working position into another position when the web which is combined within the funnel, upon arrival, is in an undesirable condition, that is, the web possesses a thick or thin place.

The monitoring unit which is used at each workstation may include two parts, namely, a stationary shaft and a sleeve which is rotatably mounted on the shaft and secured to the table for rotation about the shaft. In addition, a sensor is provided to detect a rotation of the sleeve relative to the shaft. For example, the sensor may deliver a first signal when the two parts occupy a first position corresponding to the working position of the table and a second signal when the two parts move relative to one another from the first position.

The sensor may be formed as a photoelectric barrier which is secured to the sleeve for rotation therewith and which performs a monitoring function by way of an element, such as a disk, secured to the stationary shaft.

Signal transmission means may also be provided for transmitting signals from each monitoring unit to a central station such as a common data acquisition unit. Such signals may be indicative of a fault in the web passing through the funnel of a given workstation.

The common data acquisition unit may be accommodated in an end head of the machine and may also actuate a display unit for displaying a fault occurring at a respective workstation. That is, the display unit may be actuated to show the state of operation of the machine. The data acquisition unit may also be constructed to total the number of faults caused by the individual heads in order to allow information to be collected concerning changes in the operating states of the individual heads over specific periods of time.

These and other objects and advantages of the invention will become more apparent from the following detailed description taken in conjunction with the accompanying drawings wherein:

FIG. 1 diagrammatically illustrates a combing machine constructed in accordance with the invention;

FIG. 2 diagrammatically illustrates a perspective view of a delivery table and adjacent parts of the machine of FIG. 1;

FIG. 3 diagrammatically illustrates a monitoring unit constructed in accordance with the invention as employed in the combing machine of FIG. 1;

Figure 1:
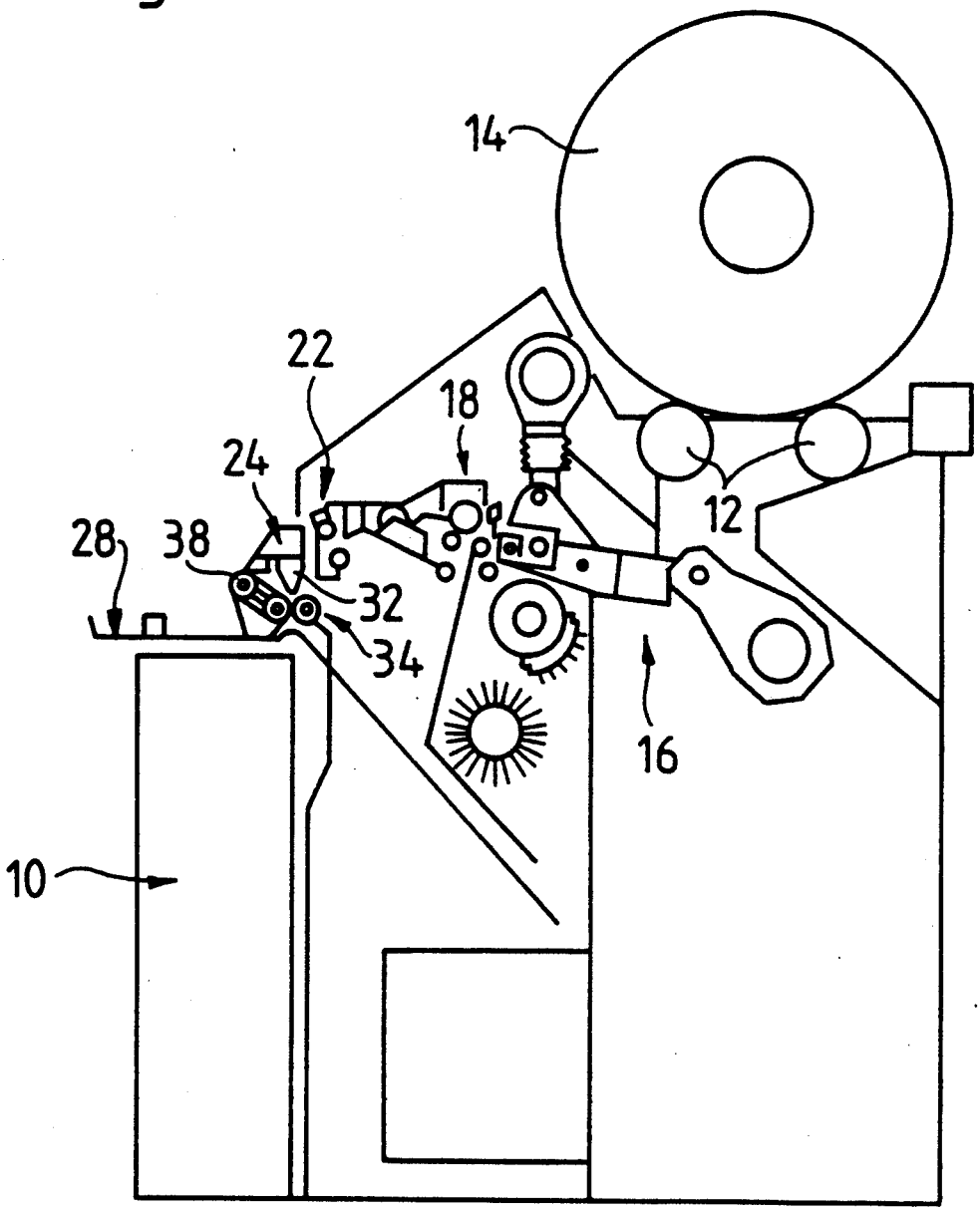

Referring to FIG. 1, the combing machine 10 is constructed in known manner, for example, in the manner of a type E7/5 combing machine manufactured by Rieter Machine Works, Ltd., Winterthur, Switzerland. As indicated, the machine 10 includes a plurality (usually eight) of individual workstations (individual heads). Each workstation comprises feed rollers 12 for unrolling a feed lap 14 in order to feed a lap 15 (FIG. 2) into downstream working elements. In addition, the machine 10 has a comb mechanism 16 with nippers, comb elements and corresponding drives (not shown in detail) as well as a detaching system 18 which are known and therefore not further described in detail.

The detaching system 18 produces a combed web 20 (FIG. 2) which is fed by delivery rollers 22 to means 24 for combining the web to form a sliver 26 delivered by the individual head. The slivers 26 delivered by the individual heads run together over a delivery table 28 to the end head of the machine (not shown) where they are drawn in known manner by a drawframe (not shown) to form a sliver delivered by the machine. The further processing of this sliver is known and is therefore not further described.

The means 24 for combining a web consists of a feed table 30 (FIG. 2) and a funnel 32 (FIG. 1) carried by the table 30, together with a pair of sliver delivery rollers 34 (FIG. 1), one roller thereof being mounted on the table 30 and the other on the machine frame. As shown, the funnel 32 and the pair of sliver delivery rollers 34 are disposed laterally of the central plane (perpendicular to the longitudinal direction) of the machine to form an inclined sliver delivery.

On the side near the funnel 32 and the pair of sliver delivery rollers 34, the table 30 extends longitudinally of the machine and with the aforesaid elements carried thereon is supported by a sleeve 36 (FIG. 2) on a stationary shaft 38 (FIG. 1) which is carried by the machine frame. The sleeve 36 is mounted rotatably on the shaft 38 so that the unit 24 (table 30, funnel 32, sliver delivery roller 34) can move about the shaft 38 between a working position and two fault positions. To this end, the table 30 is urged by a compression spring means 39 in the counterclockwise direction (as viewed in FIG. 1) about the shaft 38, i.e., the free end of the table is pressed upwards near the delivery rollers 22 (FIG. 1). This feature is known in the E7/5 machine and will therefore not be described in detail here.

During operation, the material combined by the funnel 32 exerts a force on the unit 24, such force counteracting the pressure produced by the spring means. In the normal operating state, this force is sufficient to compress a first spring 39 of the device so that the table 30 occupies a "working position" (FIG. 2) between a top position and a bottom position (not shown). In the event of a thin place in the web (outside a predetermined tolerance limit), the force exerted by the material is no longer sufficient to counteract the spring pressure, so that the table 30 is pressed further upwards (in the counterclockwise direction as considered looking at FIG. 1) by the spring 39. This movement is limited by an equilibrium of forces.

In the event of a thick place in the web (outside a specific tolerance limit), the force exerted by the material on the unit 24 increases, so that the table 30 is rotated downwards around the shaft 38 (in the clockwise direction looking at FIG. 1). A second spring of the spring device is compressed still further in these conditions, and this ultimately limits the rotary movement of the table by equilibrium of forces.

Figure 3:
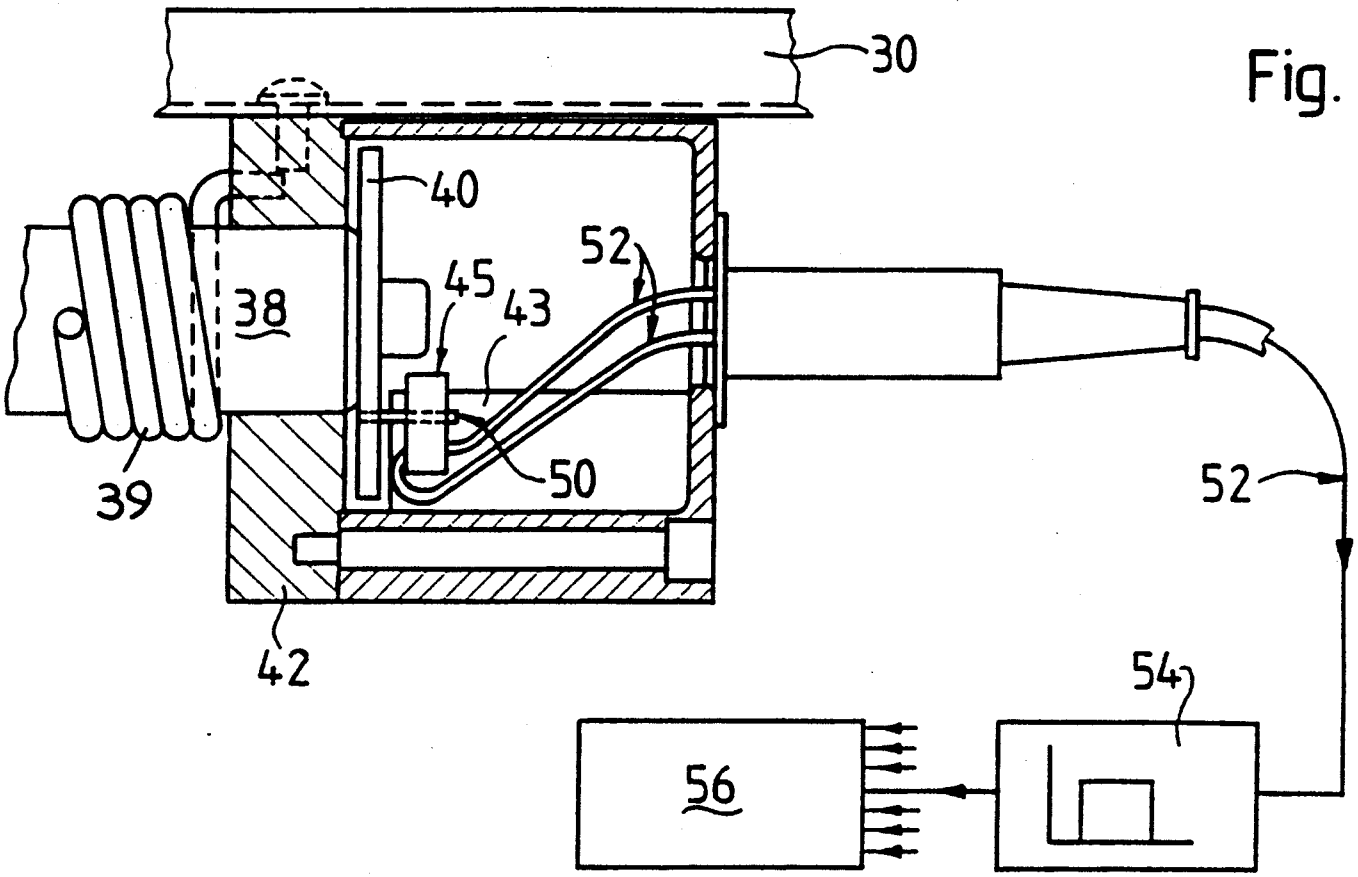

Referring to FIG. 3, each head is provided with a monitoring unit for monitoring the movement of the table 30 from the working position during movement of a combined web therethrough. As indicated, the monitoring unit includes an element in the form of a disk 40 secured to the shaft 38 at one end and a housing 42 which is secured to the table 30 for rotation therewith coaxially of the shaft 38. In addition, a bar 43 is fixed to the housing 42 and carries a sensor in the form of a photoelectric barrier 45 for monitoring the rotary movement of the disk 40.

Figure 4:
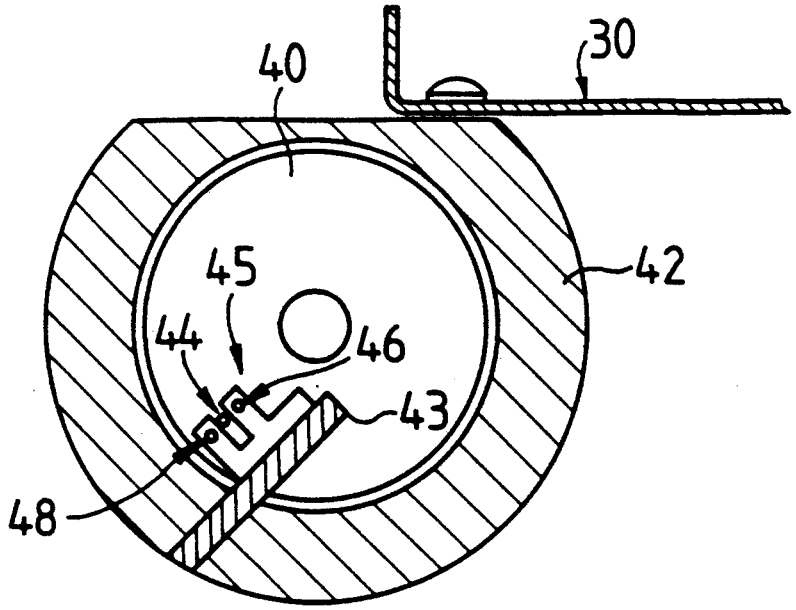
FIG. 4 illustrates an end view of the monitoring unit of FIG. 3.

Referring to FIG. 4, the photoelectric barrier 45 is formed with a slot 44 as well as a light emitter 46 on one side of the slot 44 and a light receiver 48 on the opposite side of the slot 44. The emitter 46 serves to direct a beam of light across the slot 44 to the receiver 48 unless an obstacle is moved between the emitter 46 and receiver 48. In this respect, a pin 50 is mounted on the disk 40 (see FIG. 3) so as to extend through the slot 44. As indicated in FIG. 4, should the disk 40 rotate about the axis of the shaft 38, the pin 50 is able to move more or less within the slot 44 so as to interrupt the light beam more or less.

Figure 2:
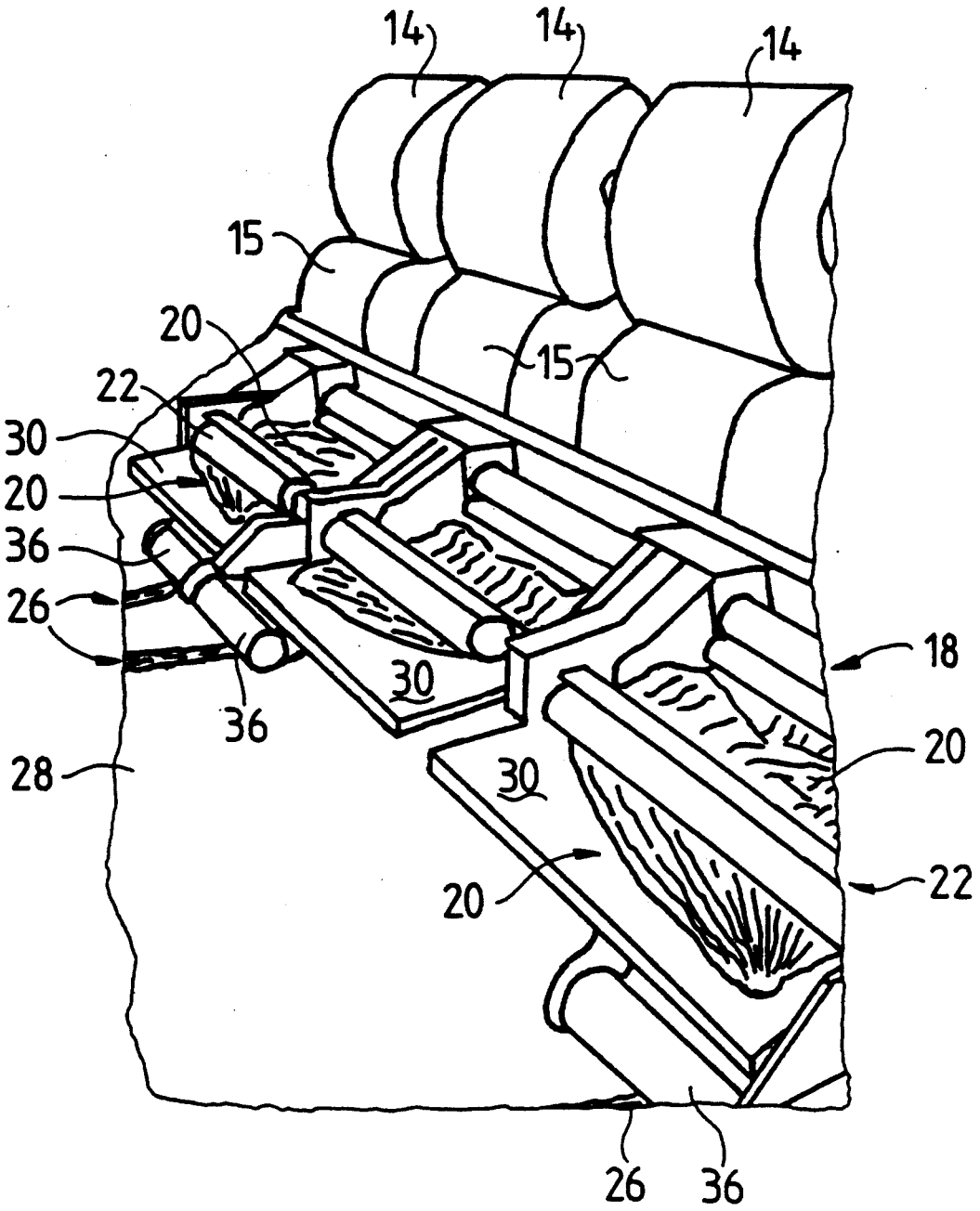

When the table 30 occupies the normal working position as indicated in FIG. 2, the pin 50 is situated between the emitter 46 and the receiver 48 in order to completely interrupt the beam of light emitted by the emitter 46. On other hand, when the table 30 moves up or down out of the working position, thereby rotating about the axis of the shaft 38, the pin 50 moves a corresponding amount along the slot 44. Depending upon the focusing of the beam of light and the dimensions of the pin 50, the sensor 46, 48 is "released", that is, the beam of light may reach the receiver 48. Thus, the signal condition of the receiver 48 is accordingly changed.

Referring to FIG. 3, each light receiver 48 is connected via an appropriate signal line 52 to a means for transmitting signals, such as a time delay element 54 and a central data acquisition unit 56 which receives signals from the respective time delay elements 54.

Each time delay element 54 prevents an immediate response to a very brief movement of a table so that the combing machine is not unnecessarily stopped. When the table 30 moves out of the fault position and back into the normal working position within a period of time defined by the time delay element 54, the element 54 is reset by the light receiver 48. In this case, no fault signal reaches the central data acquisition unit 56. On the other hand, when the table 30 remains in a faulty position beyond the determined time period, the time delay element 54 delivers a corresponding faulty signal to the unit 56. The unit 56 may then stop the combing machine and stores a corresponding fault condition signal. Fault reports of this kind can be individually totalled for the individual heads of the machine in order to show the operating conditions over any required period of time, for example one shift, one week, one month and so on. Totalling such data gives important information as to the conditions of the individual heads, for example, whether a specific individual head continuously causes faults.

The central unit may include a display unit (not shown) for displaying a fault occurring at a respective workstation. An operative may then go directly to the appropriate workstation.

Figure 5:
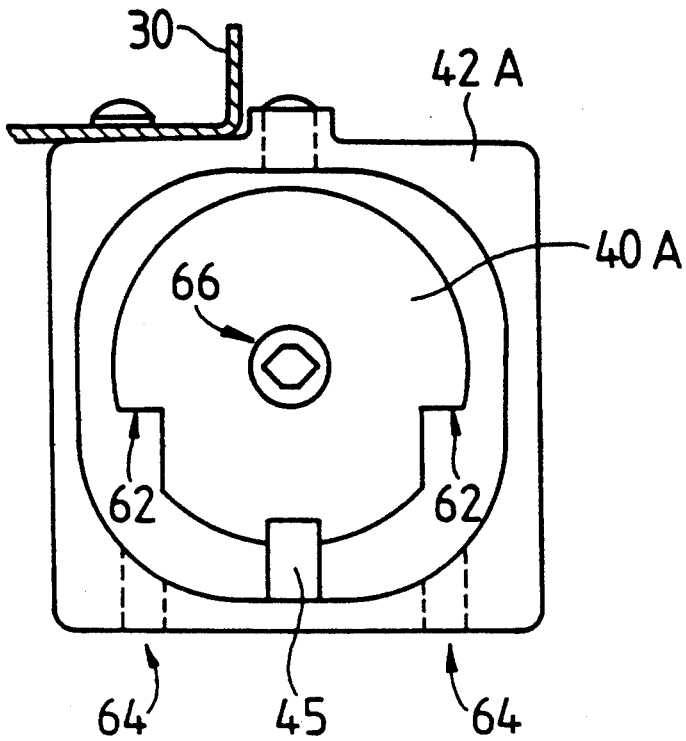
FIG. 5 illustrates an end view of a modified monitoring unit constructed in accordance with the invention.
Figure 6:
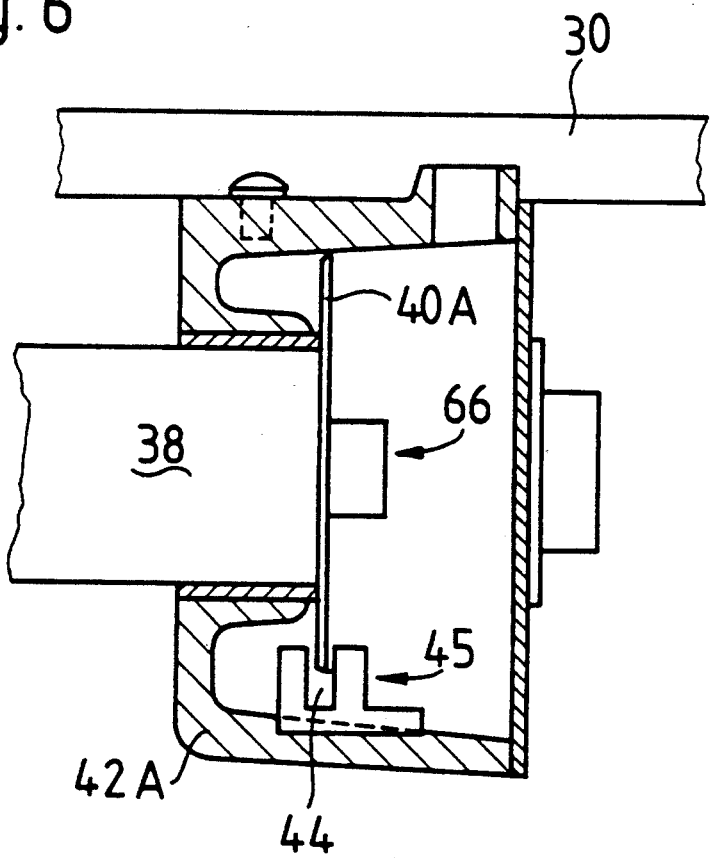
FIG. 6 illustrates a side view of the monitoring unit of FIG. 5.
Figure 7:
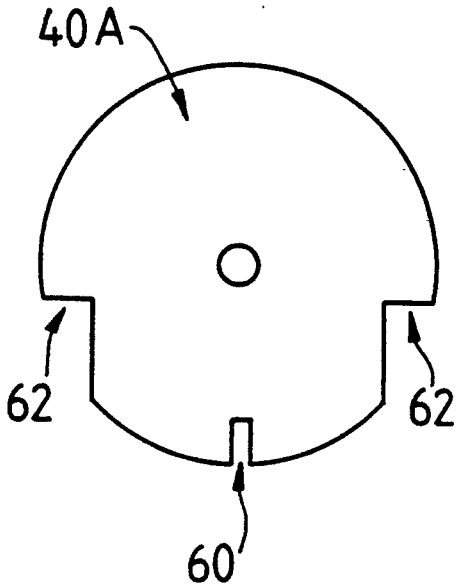
FIG. 7 illustrates a view of a disk used in the monitoring unit of FIG. 5 in accordance with the invention.

Referring to FIGS. 5 to 7, wherein like reference characters indicate like parts as above, the monitoring unit may employ a housing 42A which is secured to the table 30 and rotatably mounted on the shaft 38 via a suitable bearing. In this case, the photoelectric barrier 45 is mounted directly on the housing 42*a* and a disk 40A which is mounted on the shaft 38 projects into the slot 44 (see FIG. 6) of the photoelectric barrier 45. In addition, that part of the disk 40A which extends into the photoelectric barrier slot 44 is itself provided with a slot 60 (see FIG. 7). Thus, with the disk 40A in the working position, a beam of light may pass from the emitter 46 to the receiver 48 (not shown). The receiver 48 then respond to the beam of light and feeds a corresponding signal via signal line 52 (see FIG. 3) to the central data acquisition unit (not shown).

As indicated in FIGS. 5 and 6, the disk 40A is secured to the shaft 38 by a suitable fastening means such as a screw 66. In addition, the disk 40A has a pair of oppositely disposed shoulders 62 while the housing 40A has a pair openings 64 in alignment with the shoulders 62 for the passage of an adjustment instrument therethrough to abut a respective shoulder 62 for rotatable adjustment of the disk 40A. In order to perform an adjustment of the disk 40A, the screw 66 is released and a suitable adjustment instrument passed through an opening 64 against a shoulder 62 of the disk 40A so as to cause a rotation of the disk 40A.

During operation, in the event of a rotary movement of the table 30, the housing 42A rotates about the shaft 38 so that the slot 60 is no longer between the emitter and receiver. The beam of light is thus interrupted by the disk 40A and this condition is reported by the receiver to the central data acquisition unit.

The monitoring of the means for combing a combed web into a sliver is advantageous since the condition of this means represents a combination of the operating states of the individual heads as a whole. A single monitoring unit at this place in the work head is sufficient in cases requiring monitoring of a plurality of stations prior to combing.

The invention thus provides a monitoring unit which can be employed in a combing machine to monitor the individual workstations of the machine.

Further, the invention provides a combing machine which is able to effect the production of a higher quality yarn due to the individual monitoring of the workstations.

What is claimed is:

1. A combing machine comprising a plurality of workstations, each said workstation having means for combining a combed web into a sliver in a working position of said means, said means being movable from said working position in response to at least one of a thickened portion and a thinned portion of a combed web passing therethrough; and a plurality of monitoring units, each said monitoring unit being disposed at a respective means for combining said web, said monitoring unit being disposed for monitoring movement of said means from said working position.

2. A combing machine as set forth in claim 1 wherein said means is rotatable from said working position.

3. A combing machine as set forth in claim 2 wherein said means includes a stationary shaft, a sleeve rotatably mounted on said shaft, a table secured to said sleeve for rotation therewith and a funnel mounted in said table for passage of a combed web therethrough for combining into a sliver.

4. A combing machine as set forth in claim 3 which further comprises spring means for holding said table in said working position and wherein said monitoring unit monitors movement of said sleeve relative to said shaft.

5. A combing machine as set forth in claim 4 wherein said monitoring unit includes an element secured to said shaft, a housing secured to said table for rotation therewith coaxially of said shaft, and a sensor mounted on said housing for monitoring a rotary movement of said housing relative to said element.

6. A combing machine as set forth in claim 5 wherein said sensor is a photoelectric barrier.

7. A combing machine as set forth in claim 5 wherein at least one of said element and said sensor is adjustably mounted relative to the other.

8. A combing machine as set forth in claim 1 which further comprises a central station and means for transmitting signals form said monitoring unit to said central station corresponding to the position of said web combining means relative to said working position thereof.

9. A combing machine as set forth in claim 8 wherein said central unit includes a data acquisition unit.

10. A combing machine as set forth in claim 8 wherein said central unit includes a display unit for displaying a fault occurring at a respective workstation.

11. A combing machine as set forth in claim 10 which further comprises a time delay element for delaying a fault signal from a respective workstation until a fault continues for a predetermined time period.

12. A combing machine comprising of plurality of said means workstations;

means in each workstation for combining a combed web into a sliver in a predetermined working position thereof, said means being movable from said predetermined working position in response to at least one of a thick and a thin place in the web; and a monitoring unit at each workstation for monitoring movement of said means from said working position during movement of a combed web through said working position of said combining means.

13. A combining machine as set forth in claim 12 wherein said means includes a pivotally mounted table and a funnel in said table for passage of a combed web therethrough for combining into a sliver.

14. A combining machine as set forth in claim 13 which further comprises spring means for holding said table in said working position and wherein said monitoring unit monitors movement of said table from said working position.

15. A combing machine as set forth in claim 13 which further comprises a fixed shaft having said table pivotally mounted thereon.

16. A combing machine as set forth in claim 15 wherein said monitoring unit includes an element secured to said shaft, a housing secured to said table for rotation therewith coaxially of said shaft, and a sensor mounted on said housing for monitoring a rotary movement of said housing relative to said element.

17. A combing machine as set forth in claim 16 wherein said sensor is a photoelectric barrier.

18. A combing machine as set forth in claim 17 wherein at least one of said element and said sensor is adjustably mounted relative to the other.

19. A combing machine as set forth in claim 18 wherein said element is a disc.

20. A combing machine as set forth in claim 19 wherein said disc has a pair of oppositely disposed shoulders and which further comprises a pair of openings in said housing in alignment with said shoulders for passage of an adjustment instrument therethrough to abut a respective shoulder for rotatable adjustment of said disc.

* * * * *

UNITED STATES PATENT AND TRADEMARK OFFICE

CERTIFICATE OF CORRECTION

PATENT NO. : 4,987,648

DATED : January 29, 1991

INVENTOR(S) : HEINZ CLEMENT

It is certified that error appears in the above-identified patent and that said Letters Patent is hereby corrected as shown below:

Column 1, line 20 change "stop machine" to -stop the machine-
Column 5, line 13 change "respond to" to -responds to-
Column 5, line 20 change "pair openings" to -pair of openings-
Column 6, line 28 change "of plurality of said means workstations; to -a plurality of workstations;-
Column 6, line 31 change "thereof" to -of said means-

Signed and Sealed this

Twenty-eighth Day of July, 1992

*Attest:*

DOUGLAS B. COMER

*Attesting Officer*

*Acting Commissioner of Patents and Trademarks*